US005203847A

United States Patent [19]

Butt

[11] Patent Number: 5,203,847

[45] Date of Patent: Apr. 20, 1993

[54] MULTIPLE LAYER MAGNETIC PUZZLE

[75] Inventor: Sandra L. Butt, North Vancouver, Canada

[73] Assignee: Magnaplay Inc., North Vancouver, Canada

[21] Appl. No.: 646,446

[22] Filed: Jan. 24, 1991

Related U.S. Application Data

[63] Continuation of Ser. No. 440,681, Nov. 22, 1989, abandoned.

[30] Foreign Application Priority Data

Sep. 29, 1989 [CA] Canada ..... 614797

[51] Int. Cl.[5] ..... A63F 9/10

[52] U.S. Cl. ..... 273/157 R; 273/239; 434/73

[58] Field of Search ..... 273/156, 157 R, 239; 434/73, 81, 96, 403; 446/137, 138, 139, 92, 901

[56] References Cited

U.S. PATENT DOCUMENTS

| | | | |
|---|---|---|---|
| D. 228,299 | 9/1973 | Jones | 273/157 R |
| D. 228,359 | 9/1973 | Jones | 273/157 R |
| 760,384 | 5/1904 | Dieterich | 273/157 R |
| 1,168,949 | 1/1916 | McKittrick et al. . | |
| 1,480,458 | 1/1924 | Mershon | 273/157 R |
| 1,787,473 | 1/1931 | Dana | 273/157 R |
| 1,942,339 | 1/1934 | Lawrence | 273/157 R |
| 2,002,077 | 5/1935 | Darling et al. | 446/92 |
| 2,395,129 | 2/1946 | Lewis | 434/406 |
| 2,674,813 | 4/1954 | Hutchinson | 273/157 R |
| 3,010,228 | 11/1961 | Torre . | |
| 3,196,579 | 7/1965 | Lepper | 446/92 |
| 3,618,955 | 11/1971 | Barnes | 273/157 R |
| 3,865,382 | 2/1975 | Myller | 273/157 R |
| 4,030,736 | 6/1977 | Petrusek | 446/92 |
| 4,205,850 | 6/1980 | Craig . | |
| 4,422,642 | 12/1983 | Fletcher | 434/406 |
| 4,776,802 | 10/1988 | Rind et al. | 273/157 R X |
| 4,900,604 | 2/1990 | Martinez et al. | 40/594 |
| 4,937,181 | 1/1990 | Rogers | 273/157 R |

FOREIGN PATENT DOCUMENTS

| | | | |
|---|---|---|---|
| 2506056 | 8/1976 | Fed. Rep. of Germany | 40/594 |
| 242367 | 10/1946 | Switzerland | 273/156 R |

OTHER PUBLICATIONS

"Stick Ons", Popular Mechanics, Dec. 1949, vol. 92, No. 6, p. 139, 446/901.

*Primary Examiner*—V. Millin
*Assistant Examiner*—William M. Pierce
*Attorney, Agent, or Firm*—John Russell Uren

[57] ABSTRACT

A magnetic puzzle for educational purposes comprises a plurality of pieces. Each of the pieces has a magnetic side and a graphics side and is adapted to be attached to a metallic board. The pieces are of a thickness such that two or more pieces may be positioned one upon the other with the bottom piece attached to the metallic board.

2 Claims, 6 Drawing Sheets

FIG. 4A
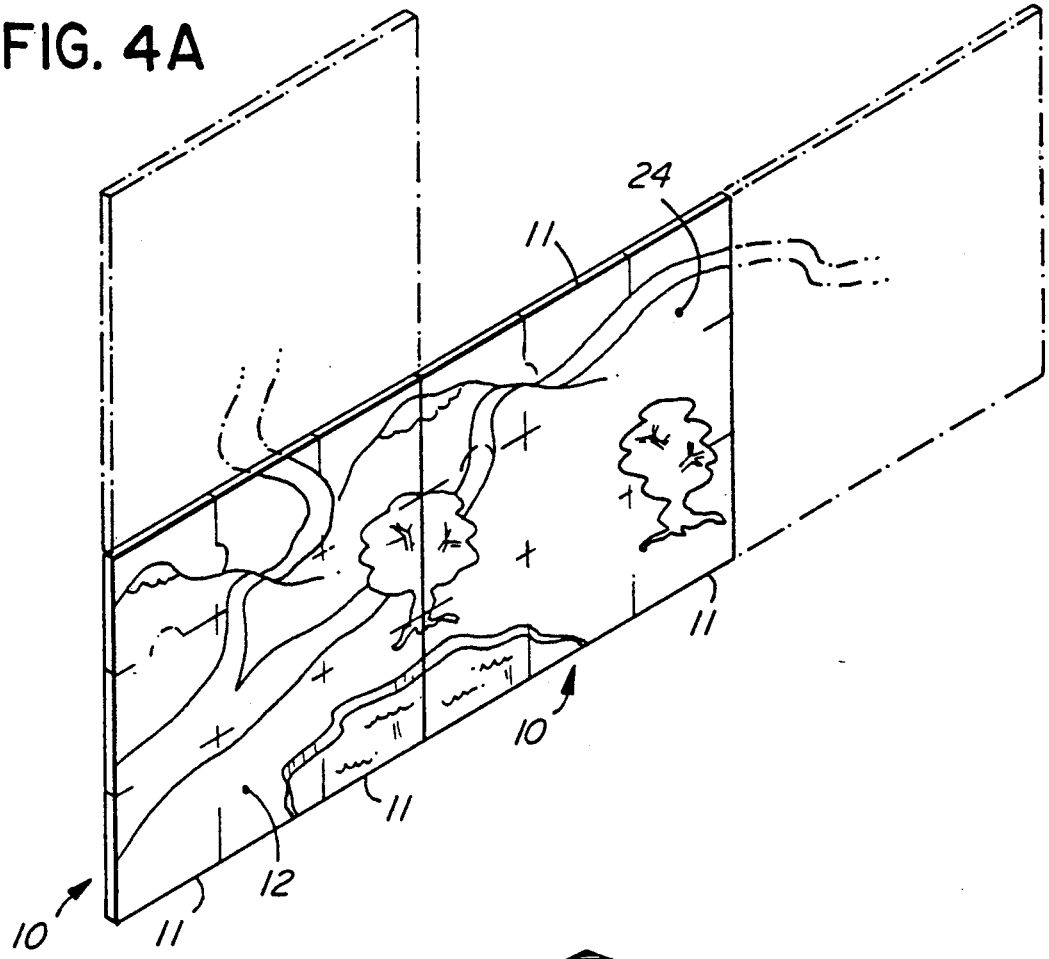
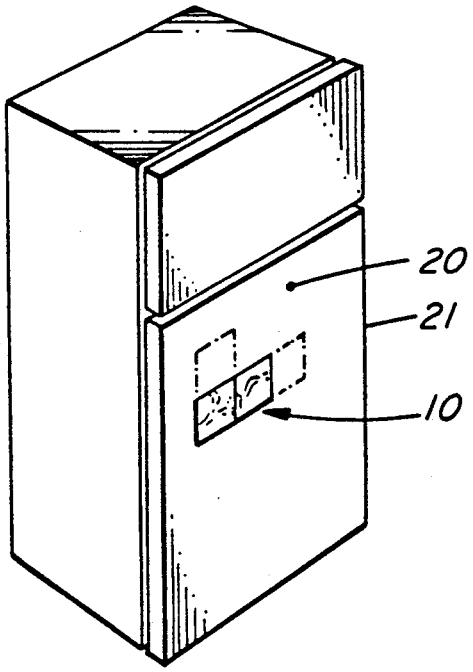
FIG. 4B

MULTIPLE LAYER MAGNETIC PUZZLE

This application is a continuation of application Ser. No. 07/440,681, filed Nov. 22, 1989, now abandoned.

This invention relates to a magnetic puzzle and, more particularly, to a magnetic puzzle used directed towards educational purposes for children.

BACKGROUND OF THE INVENTION

There are, of course, many different types of puzzles available for purchase. Such puzzles include pictorial puzzles where the various pieces fit together to form a picture.

Such puzzles have pieces, however, that do not adhere to the surface on which they are used. They are, therefore, ordinarily used on a flat horizontal surface and, if the surface or pieces are inadvertently jarred, the pieces will come apart. Such puzzles are normally not played by children to any great extent since they, are usually complicated and have small pieces and do not lend themselves to the lack of manual dexterity inherent in young children.

Magnetism and magnets offer a fascination to children and, when used with puzzles, they allow the child to partially assemble the puzzle without the puzzle becoming disassembled if the surface or pieces are accidentally jarred.

Such puzzles, however, are rarely if ever used for spelling and arithmetic functions. There is a puzzle used which has a series of letters with magnetic backing. The letters are each individually movable and may be assembled to form a word which is provided to the youngster. However, there is rarely an indication given to the youngster as to what subject matter the word covers. Further, they are not puzzles in the sense of interlocking pieces.

SUMMARY OF THE INVENTION

According to the invention, there is disclosed a first magnetic puzzle comprising a plurality of pieces, each of said pieces having a magnetic side and a graphics side, each of said pieces being operable to be attached to a metallic board by said magnetic side, said pieces being of a thickness that two or more pieces may be stacked one upon another on said metallic board.

According to a further aspect of the invention, there is disclosed first and second puzzles, each of said puzzles having a respective pictorial thereon, said pictorials, when joined, illustrating a third pictorial combining said first and second pictorials.

According to yet a further aspect of the invention, there is disclosed a pictorial comprising a plurality of elements, each of said elements having a common name and a shape, a plurality of pieces, each of said pieces having a shape substantially identical to the shape of a respective element, each of said pieces carrying a single letter identical to the first letter of the common name of said respective element.

According to yet a further aspect of the invention, there is disclosed a puzzle having pieces operable to form a pictorial, a plurality of said pieces each bearing a respective number, each of said plurality of pieces differing in size by a predetermined amount such that when the addition of said numbers of a first series of said pieces give a number on a further piece, said first series of pieces will substantially fit the shape of said further piece.

According to yet a further aspect of the invention, there is disclosed a puzzle having a plurality of pieces operable to form a pictorial, said plurality of pieces forming a first and second series, said first series each having a different number of elements thereon and said second series each having a number thereon which corresponds to the number of elements in each of said first series, a piece of said first series having elements thereon fitting a piece of said second series with a number thereon corresponding to the number of elements.

BRIEF DESCRIPTION OF THE SEVERAL VIEWS OF THE DRAWINGS

Specific embodiments of the invention will now be described, by way of example only, with the use of drawings in which:

FIG. 4A is a diagrammatic isometric view of several of the assembled puzzles of FIG. 1 and further illustrating the mating pictorials of the assembled puzzles when they are put side to side;

FIG. 4B is a diagrammatic isometric view of a refrigerator illustrating several of the mated puzzles of FIG. 4A on a door;

DESCRIPTION OF SPECIFIC EMBODIMENT

Figure 1:
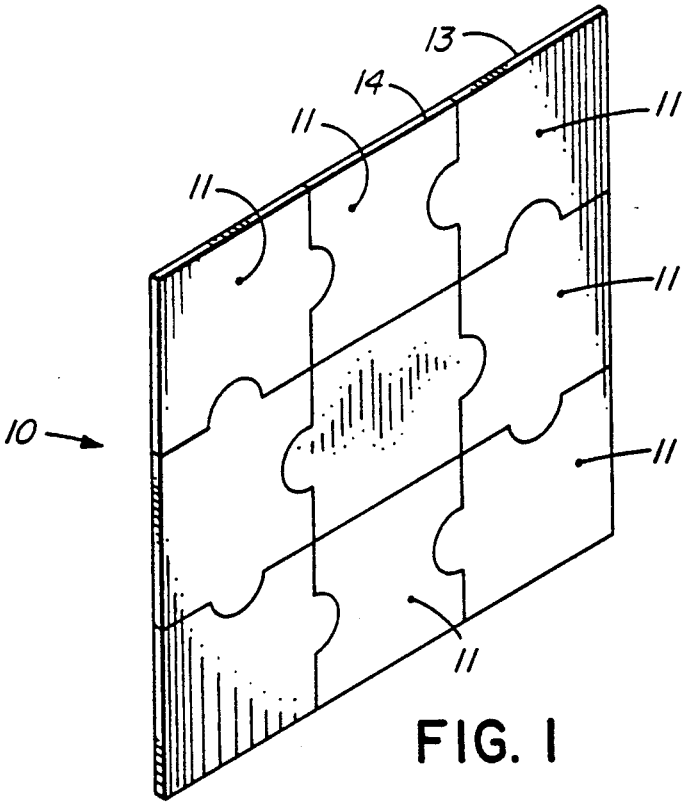
FIG. 1 is a diagrammatic isometric view of the puzzle according to the invention in its assembled form.

Referring now to the drawings, a puzzle according to the invention is generally illustrated at 10 in FIG. 1. It comprises a plurality of individual pieces 11 which fit together to form a pictorial 12 (FIG. 4A) as is known in the art.

Each of the pieces 11 has a magnetic side 13 made from a thin flexible magnet material and a graphics side 14, the magnetic side 13 being attached to a metallic surface 20 such as a refrigerator door 21 (FIG. 4B).

Figure 2:
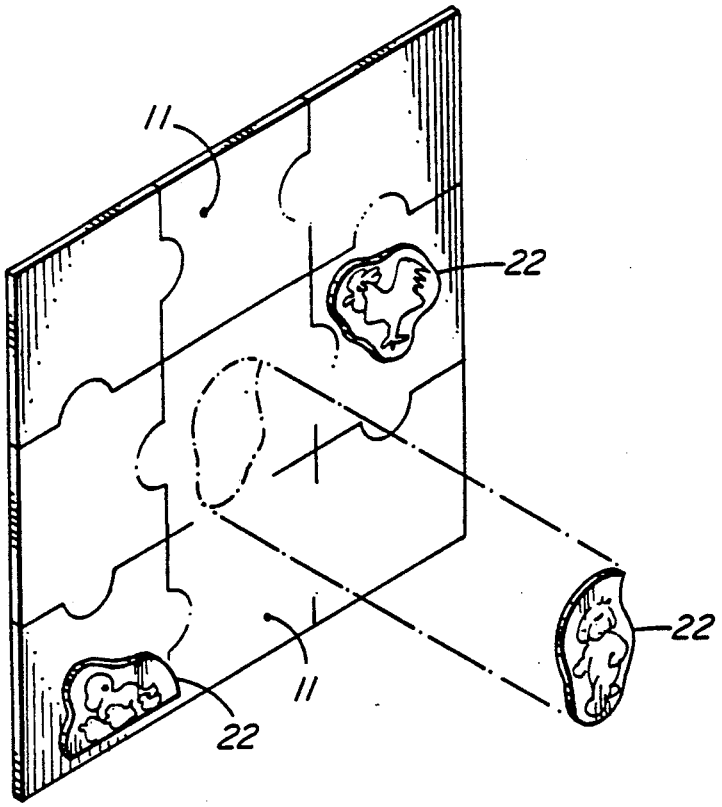
FIG. 2 is a diagrammatic isometric view of the puzzle of FIG. 1 but illustrating a few of the pieces which can be attached to the assembled puzzle in a first layer.

Reference is now made to FIG. 2 wherein a further number of "second layer" pieces 22 are illustrated. These second layer pieces 22 are of the same thickness as the "first layer" pieces 11 and may be mounted on the first layer pieces 11 as shown, the flexible magnetic material of the second layer pieces 22 retaining the pieces on the first layer pieces 11.

Figure 3A:
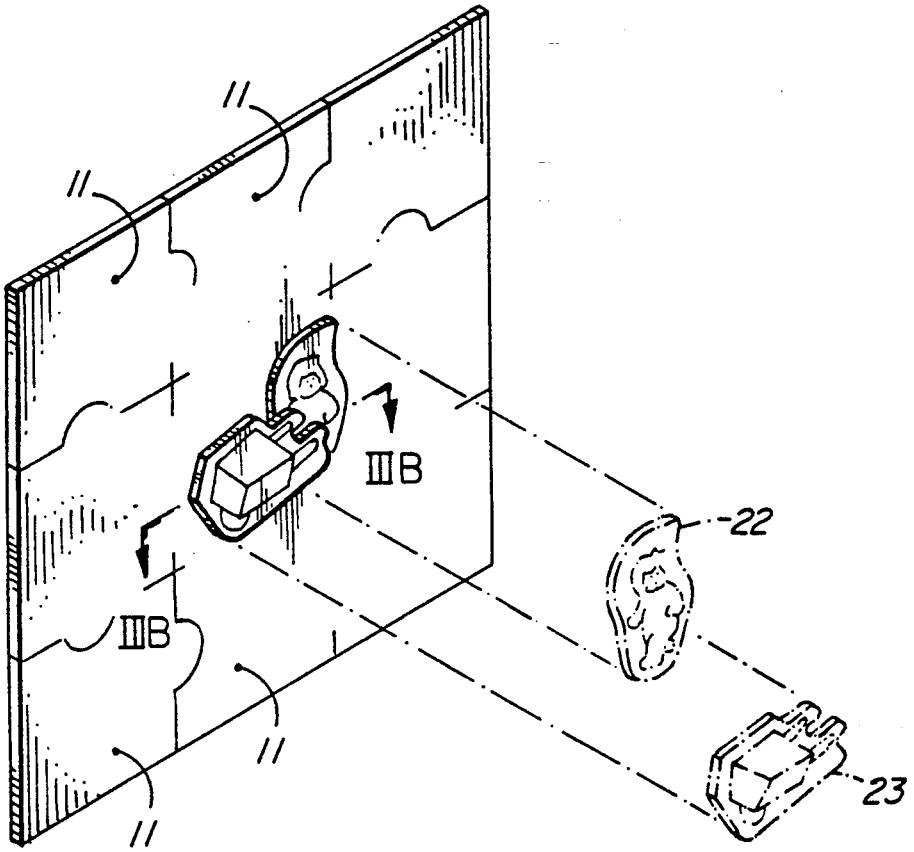
FIG. 3A is a diagrammatic isometric view of the puzzle of FIGS. 1 and 2 but illustrating two of the pieces which can be attached to the assembled puzzle to form a first and second layer.
Figure 3B:
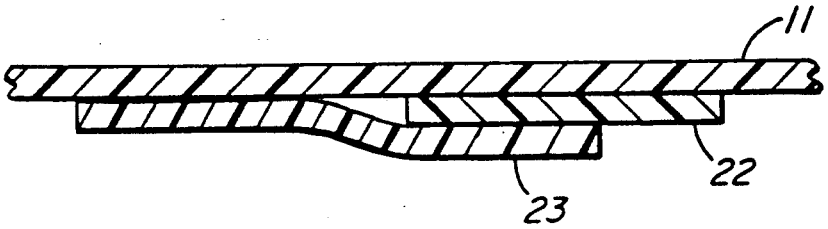
FIG. 3B is a sectional view of the assembled puzzle of FIG. 3A and taken along the section IIIB—IIIB.

With reference now to FIGS. 3A and 3B, a further "third layer" piece 23 is attached to the second layer piece 22 and also to the first layer piece 11. Thus, it will be seen that a child may place a second layer piece 22 on the pictorial of the assembled puzzle 10 where the child feels the piece 22 would look appropriate and, as well, place a third layer piece 23 partially on a second layer piece 22 and a first layer piece 11. This process can continue until the thickness of the stacked pieces is such that the magnetic attraction is no longer sufficient to keep the stacked pieces together.

A further attribute of the puzzle 10 according to the invention is illustrated in FIG. 4A. In this figure, it will be seen that a number of individual puzzles 10, each having a plurality of pieces 11, may be mated together such that the pictorial 12 on one puzzle 10 matches up with the pictorial 24 when the puzzles 10 are placed side to side. Likewise, further puzzles 10 may also be added, enlarging the size of the overall pictorial created when the various puzzles are placed together.

OPERATION

In operation, the child will have at his disposal a plurality of pieces 11, each being of the same thickness and having a graphics side 14 and a flexible magnetic side 13. He will further have at his disposal a series of second and third layer pieces 22, 23.

The child may commence to assemble the pieces 11 to form the puzzle 10 on the metallic surface 20 of the refrigerator door 21 but, clearly, any metallic surface 20 would suffice. The child will assemble the first layer of pieces 11 to form the puzzle 10 and, thereafter, mount the second layer of pieces 22 to the puzzle 10 where it is desired to mount them. A third layer of pieces 23 may then be mounted to the second layer of pieces 22 as viewed in FIGS. 3A and 3B in order to form a three dimensional pictorial which is satisfying to the child. The process may continue and the child may add more pieces to form more layers.

The child may also move to assemble more than one puzzle 10 and, if so, he may desire to place the puzzles side by side as illustrated in FIG. 4A, in which case the several puzzles will form a larger pictorial that matches the pictorials on each of the individual puzzles when they are placed side by side.

Figure 5:
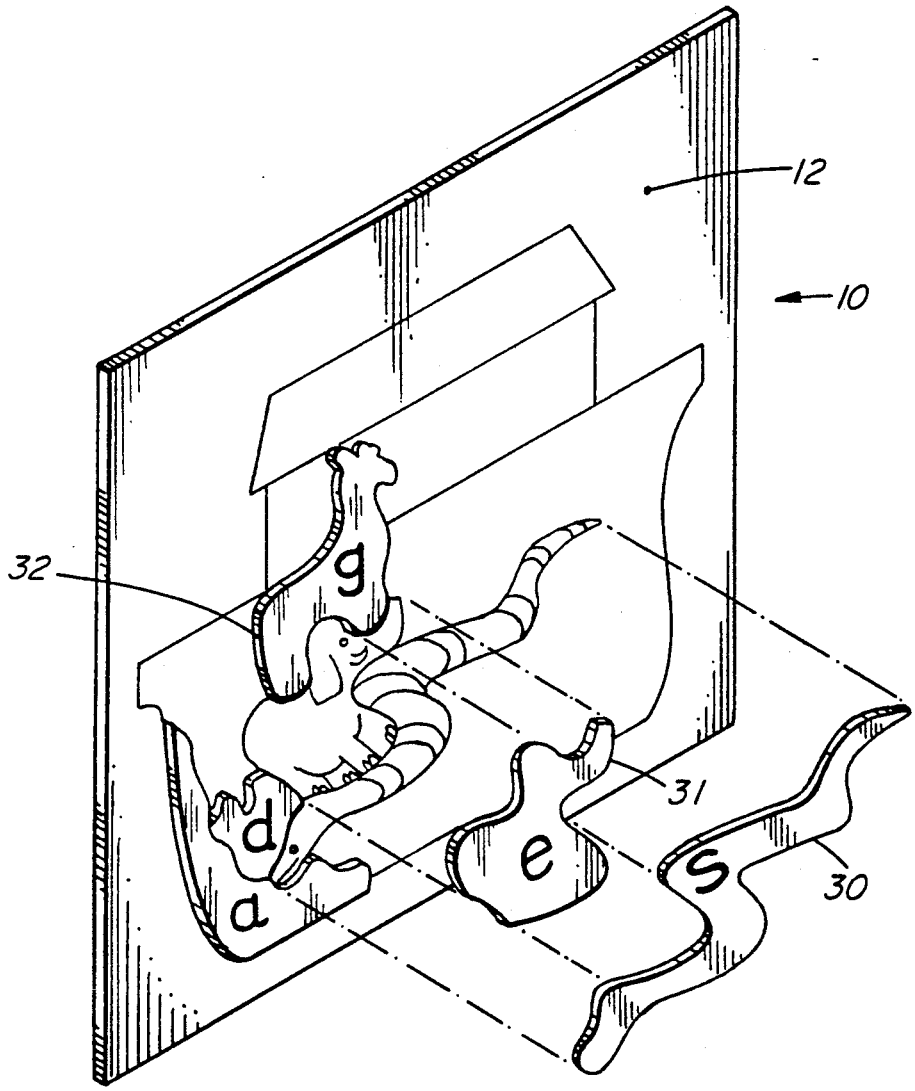
FIG. 5 is a diagrammatic isometric view of a further embodiment of a puzzle according to the invention.

A further embodiment of the invention is illustrated in FIG. 5. In this embodiment, the pictorial 12 on a metallic surface is shown. The pictorial 12 is a "Noah's Ark" which illustrates a number of animals, birds, reptiles and the like in a boat or ark. Each of the animals, etc. shown in the pictorial is overlaid by a single piece and the individual pieces 30,31,32 resemble the respective shape of the animal as, for example, a snake, an elephant and a giraffe which are shown. Each piece 30, 31, 32 also carries the first letter of the animal which it resembles such as the letter "s" for snake, the letter "e" for elephant and the letter "g" for giraffe.

In operation, the child can remove and replace the individual pieces 30,31,32 by shape. He will also come to identify the letter on the individual piece with the name of the animal which the piece resembles.

A further embodiment of the invention is illustrated in FIG. 6. Referring initially to FIG. 6A, a puzzle generally illustrated at 40 has the usual flexible magnetic side 41 and the pictorial side 42 and is used with a metallic surface as described. The pieces 46 have a number of elements such as animals, humans or the like shown thereon, the number of which corresponds to the number on the fitted pieces 43 therebelow.

Figures 6A, 6B:
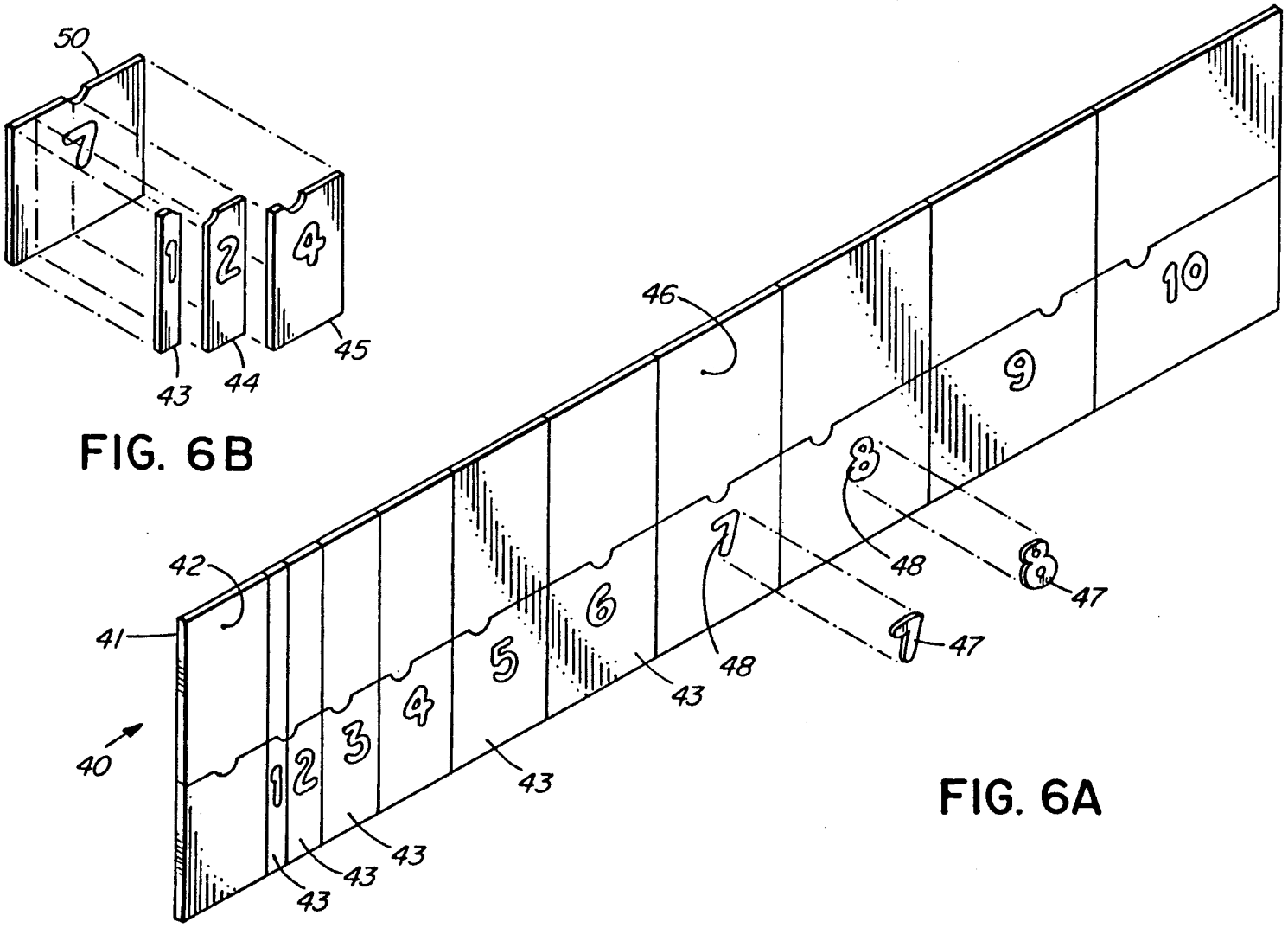
FIG. 6A is a diagrammatic isometric view of yet a further embodiment of a puzzle according to the invention.
FIG. 6B is a diagrammatic isometric view of the puzzle of FIG. 6A but illustrating the educational aspect of arithmetic.

In this puzzle, in addition, each of the plurality of individual pieces 43, 46, carrying the number differs in size from the predecessor piece by a predetermined amount and carries a number from 1 to 10. The predetermined amount is that amount which will allow the placement of two or more pieces over another piece such that the area of the other piece will be conterminously covered by the area of the two or more pieces. With reference to FIG. 6B, for example, it will be seen that the three pieces 43,44,45 numbered "1", "2" and "3", respectively, will cover the piece 50 numbered "7". Likewise, the two pieces numbered "1" and "2" will conterminously cover the piece numbered "3" and so on. Also, it will be noted that the pieces 43, 44, 45 numbered "1", "2", and "3" respectively, will fit on to the piece 46 which has seven elements thereon so that the child can observe the number corresponding to the elements. It will also be noted that the numbers 47 may be overlaid or fitted into the numbers 48 on the pieces 43.

Figure 6C:
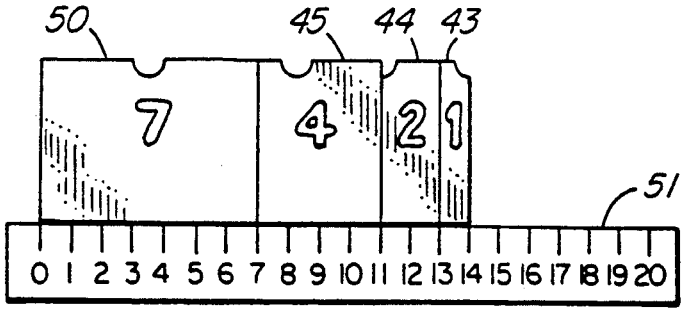
FIG. 6C is a view of the puzzle of FIGS. 6A and 6B but illustrating a further arithmetic aspect of the puzzle according to the invention.
Figure 6D:
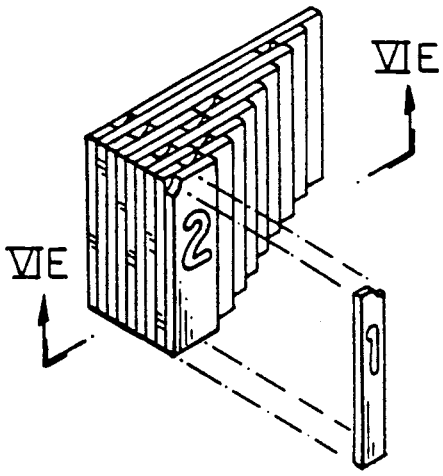
FIG. 6D is a diagrammatic isometric view of the ten stacked pieces of FIG. 6A.
Figure 6E:
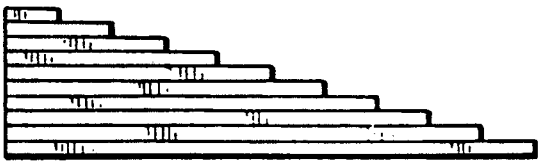
FIG. 6E is a view of ten stacked pieces of FIG. 6D taken along VIE—VIE of FIG. 6D.

Referring to FIGS. 6C, 6D and 6E, a ruler 51 can be provided on which the numbered playing pieces can be measured so that some estimate of the width of each piece can be obtained by the child and which also illustrates the rules of addition and substraction.

As seen from FIG. 6C, each division in the ruler 50 corresponds to the width of the piece 43 numbered "1". Thus, when the pieces 50, 45,44, 43 are placed together, they will add up to 14 on the ruler 50. The child, therefore, experiences the addition result of pieces of different sizes being placed together. As seen in FIGS. 6D and 6E, the various pieces may be "stacked" so as to form a neat pile of pieces having symmetry when the pieces are positioned in proper order thereby allowing the child to visually see the different sizes of the pieces.

It is contemplated that, rather than letters being used the pieces of the FIG. 5 embodiment, names may be used. Likewise, other identifications for the pieces could be made such as fruit, cars and the like but the same inventive principals would apply.

It is further contemplated that the FIG. 5 and 6 embodiments could be used by a child without the need for magnetism and the metallic surface. Indeed, while the magnetic aspects of these two embodiments are conveniently used, the educational aspects would remain the same regardless of whether the pieces were magnetic.

Many further modifications will readily occur to those skilled in the art and the specific embodiments illustrated are given by way of example only and should not considered as limiting the scope of the invention as defined in accordance with the accompanying claims.

What is claimed is:

1. A puzzle comprising a first set of pieces, each having a graphics side and a magnetic side for attachment to a metallic surface, said pieces having mating formations for assembly of the pieces in abutting relationship into an assembled form for forming a graphic representation in a first plane; and a second set of pieces, each having a graphics side which is provided with a graphic representation of a complete object thereon and a magnetic side for attachment to the graphics side of one or more of the first set of pieces in said assembled form in a second plane located above said first plane.

2. A puzzle according to claim 1, further comprising a plurality of said first sets of pieces, the pieces of each of said first sets having mating formations for assembly of the pieces of each of said first sets in abutting relationship into an assembled form for forming a particular graphic representation, wherein said sets, in said assembled forms, have perimeters with mating formations thereon for assembly of said sets in abutting relationship for forming a graphic representation combining said particular graphic representations of said first sets of pieces.

* * * * *